United States Patent [19]

Harmon

[11] 4,091,140

[45] May 23, 1978

[54] CONTINUOUS FILAMENT NONWOVEN FABRIC AND METHOD OF MANUFACTURING THE SAME

[75] Inventor: Carlyle Harmon, Provo, Utah

[73] Assignee: Johnson & Johnson, New Brunswick, N.J.

[21] Appl. No.: 684,687

[22] Filed: May 10, 1976

[51] Int. Cl.[2] ..... D04H 1/58

[52] U.S. Cl. ..... 428/288; 156/167; 156/181; 156/244.22; 156/272; 264/22; 428/296; 428/297; 428/482; 428/910

[58] Field of Search ..... 264/210 F, 22, 25, 236; 156/244, 272, 273, 167, 181; 428/288, 296, 297, 482, 483, 910

[56] References Cited

U.S. PATENT DOCUMENTS

| | | | |
|---|---|---|---|
| 3,439,085 | 4/1969 | Hartmann | 156/167 |
| 3,509,009 | 4/1970 | Hartmann | 264/210 F |
| 3,692,618 | 9/1972 | Dorschner et al. | 156/167 |
| 3,878,019 | 4/1975 | Chapman et al. | 264/22 |

*Primary Examiner*—James J. Bell
*Attorney, Agent, or Firm*—Charles J. Metz

[57] ABSTRACT

A new continuous filament nonwoven fabric wherein: a portion of the filaments are substantially randomly deposited, at least partially molecularly oriented crystalline synthetic polymer filaments; and another portion of the filaments are cross-linked polymerized materials which act as a bonding agent for the fabric.

14 Claims, 3 Drawing Figures

CONTINUOUS FILAMENT NONWOVEN FABRIC AND METHOD OF MANUFACTURING THE SAME

The present invention relates to bonded continuous filament nonwoven fabrics and methods for manufacturing the same.

In recent years a new process for making nonwoven fabrics has been developed. Broadly, the process comprises extruding synthetic polymers as continuous filaments and collecting the filaments in web form. The fabrics made by this process have been termed "spunbond fabrics". A great number of variations have been developed for producing spunbond fabrics but broadly they all comprise taking a fiber-forming orientable polymer, such as the polyolefins, polyesters or polyamides, melting the polymer and extruding the molten polymer through a spinnerette of some nature to form continuous filaments. The filaments are drawn by air currents or similar techniques to orient the filaments and the filaments collected in a random haphazard way in wide width form on some type of moving conveyor. The filaments may be collected before they are completely solidified so they adhere to each other at their crossover points. In some instances when using the thermoplastic materials, such as the polypropylenes, the web of continuous filaments may be embossed with heat and pressure to bond the continuous filament web at various points. In other instances two different types of filaments may be extruded. For example, high-melting polyamide filaments along with low-melting polyamide filaments may be extruded and collected and the web heated to melt the low-melting polyamide to bond all the filaments together. In other instances, the web of filaments may be after-treated by any of the well-known resin bonding techniques to produce the desirable spunbond fabric.

I have developed a new type of spunbond material which is very strong and durable. My new spunbond fabric may be made incorporating any of the known fiber-forming polymers and may have any of the desirable properties of such fiber-forming polymers while still having excellent strength and durability. Furthermore, my new fabric may be soft and drapeable.

My new nonwoven fabric comprises a layer of substantially continuous randomly deposited filaments. A first portion of these filaments is made from at least partially molecularly oriented, crystalline, synthetic polymer. A second and separate portion of these filaments is made from a cross-linked polymerized material selected from the class consisting of unsaturated polyester polymers, unsaturated polyurethane polymers, unsaturated epoxy bis-phenol A resins, modified silicones, unsaturated acrylate copolymers, block copolymers of the styrene and butadiene, and mixtures thereof. The filaments of the second portion are bonded to each other and to the molecularly oriented filaments to produce the desired unitary fabric.

My new continuous filament nonwoven fabric is made by extruding a plurality of filaments a portion of which is made from molecularly oriented crystalline synthetic polymer and a portion of which is made from cross-linkable polymerizable materials. The filaments are extruded simultaneously and at least partially drawn to molecularly orient the orientable polymer. The filaments are collected as a layer on a suitable conveyor means in a random, haphazard, non-parallel form. If desired, the layer of filaments may be heated and pressed. The layer of filaments is treated with electron beam radiation to cross-link and polymerize the polymer material and bind all of the filaments together to produce a strong, durable, washable, spunbond fabric.

The present invention will be more fully described in conjunction with the accompanying drawings wherein:

FIG. 3 is a cross-sectional view taken along line 3—3 of FIG. 2.

Figure 5:
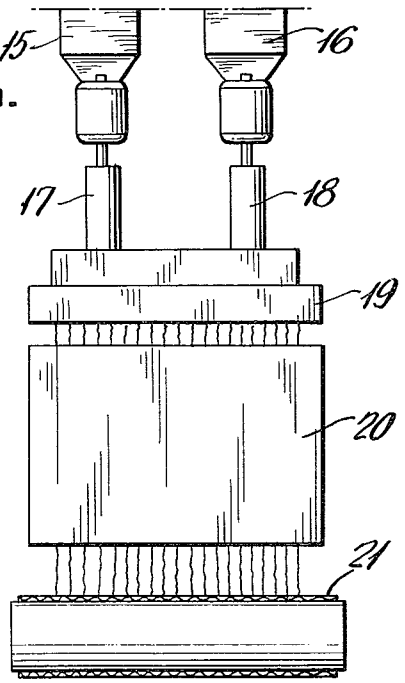
Figure 1:
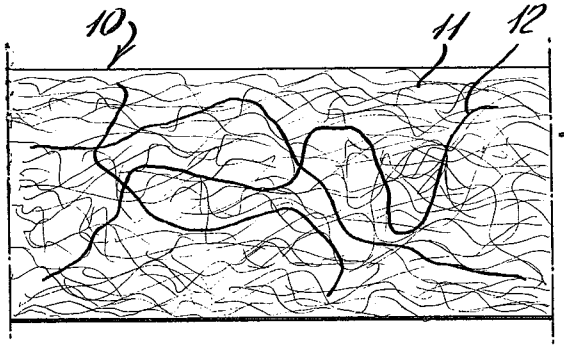
FIG. 1 is an enlarged schematic plan view of a portion of a new spunbond fabric made according to the present invention.

Referring to FIG. 1 of the drawings, there is shown a fabric 10 comprising two different types of continuous filaments. All of the filaments are randomly disposed in more or less haphazard arrangement and crossed and wound over and about each other. A portion of the filaments are non-bonding filaments 11 and are used primarily to provide strength and other desirable properties in the fabric. The other portion of filaments, randomly disposed in and around and within the non-bonding types of filaments, are the binder filaments 12 which provide some strength, hold the fabric together and give it integrity.

Figure 2:
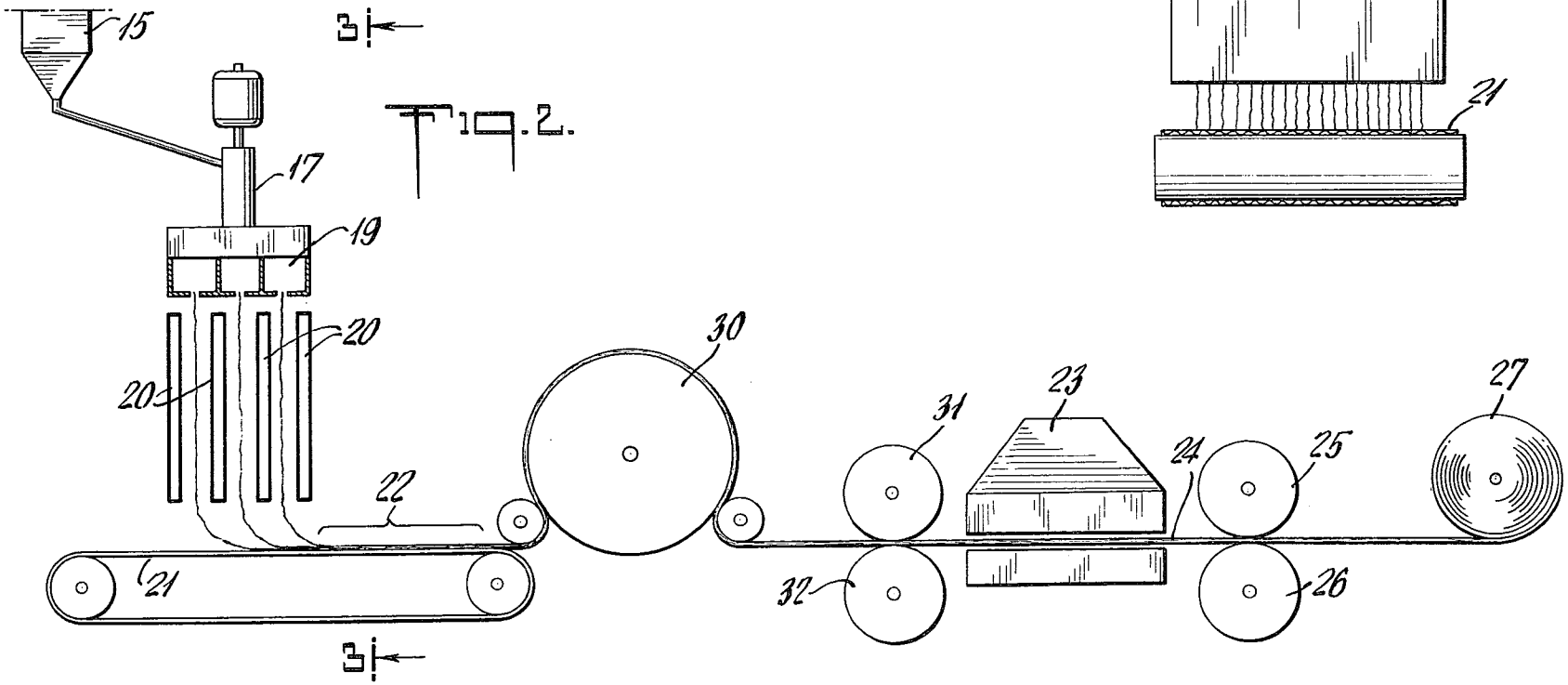
FIG. 2 is a schematic view of one embodiment of the precess for producing the spunbond fabrics of the present invention.

In FIG. 2 there is shown schematically a process for producing the spunbond fabric of the present invention. As may be seen in FIG. 3, polymer chips of a fiber-forming orientable material are held in one tank 15 and polymer chips of the bonding material, in accordance with the present invention, are held in another tank 16.

The polymers are fed through suitable heated extrusion means 17 and 18 to melt the polymers and feed molten polymer to a series of spinnerettes 19. The nozzles or holes in the spinerettes are connected to the extrusion apparatus in a manner so that some are connected to the bonding polymer extrusion apparatus while the remainder are connected to the non-bonding polymer extrusion apparatus. Generally the spinnerette holes should be more or less uniformly disposed in and amongst each other to produce a mixture of filaments of the two different types of polymers. It is preferred that the spinnerettes be oscillated a short distance in the transverse direction to aid in obtaining a uniform lay of filaments. The polymers are extruded downwardly through the spinnerette through a series of baffled air channels 20. Air is directed along the surface of the extruding polymers to at least partially draw and orient the non-bonding polymer. The extruded filaments are collected on a permeable conveyor means 21 so that excess air is allowed to pass through the permeable means and the filaments collected in wide width form. The upper reach of the conveyor with the filaments thereon pass through an air space 22 to allow the filaments to partially harden. The filament web is removed from the conveyor and passed around a portion of the periphery of a heated drum 30. If desired, the web may be pressed against the surface of the drum to obtain better heat transfer. The heated web is removed from the drum and passed through a pair of calendering rolls 31 and 32 to press and embed the filaments together. The heated and pressed filaments are passed through an electron beam radiation apparatus 23 such as that manufactured and sold by Energy Sciences, Inc., of Bedford, Massachusetts or High Voltage Engineering of Burlington, Massachusetts. The bonding filaments are treated with the electron beam radiation to cross-link the polymer and bond the filaments together to produce a strong, durable spunbond fabric 24. The fabric passes through a pair of rolls 25 and 26 and is rolled up on a standard wind-up mechanism 27.

The non-bonding filaments may be made from any of the well-known fiber-forming polymers such as the polyamides, the polyesters, the polyolefins, etc. These well-known fiber-forming polymer materials may be drawn and the polymers oriented to produce strength. The polymers themselves are crystalline-type polymers and these polymers are used to provide the desired strength, absorbency, abrasion resistance and other desirable fiber properties in the final fabric.

The bonding filaments are made from polymer materials which are probably better classified as pre-polymers or low molecular weight polymers and which are unsaturated. Usually these polymer materials have a low softening point of less than about 150° C and usually in the range from about 80° to 85° C. Preferably, these polymers will also contain a modest amount of polyfunctional cross-linking monomer. The polymer materials that are used to produce the bonding filaments of the present invention are the unsaturated polyester polymers, the unsaturated polyurethane polymers, the unsaturated epoxy bis-phenol A resins, modified silicones, unsaturated acrylate copolymers and block copolymers of styrene and butadiene.

Suitable unsaturated polyester polymers are those produced by combining acids; such as phthalic acid, isophthalic acid, adipic acid and the like, with unsaturated acids; such as fumaric acid, maleic acid and the like, and condensing the acids with a dihydric alcohol; such as polyethylene glycol, diethylene glycol, the butane diols, etc. The resultant prepolymers will have a chemical formula similar to the following:

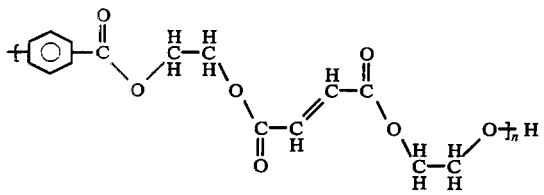

Suitably unsaturated polyurethane polymers are those produced by reacting unsaturated polyesters; such as poly (1,4)-butylene fumarate, with the diisocyanates; such as 2,4 toluene diisocyanate, diphenyl methane diisocyanate and the like. The resulting prepolymers will generally have a formula such as:

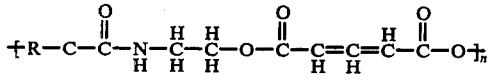

where R is polyethylene oxide or polypropylene oxide; or

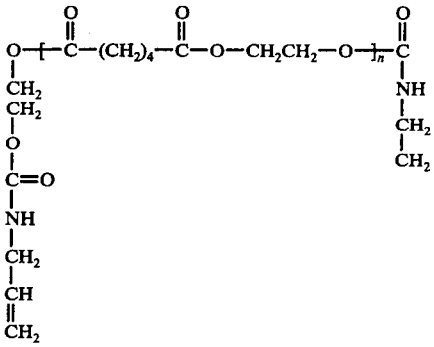

The unsaturated epoxy bis-phenol A resins are those primarily formed by reacting epichlorohydrin with bis-phenol A to form the diglycidyl ether. The ether is then reacted with a di-functional carboxylic acid, such as maleic acid, to form a suitable unsaturated polymer having a melting point of about 165° C and a chemical formula as follows:

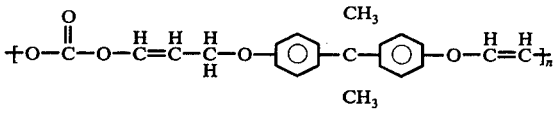

Examples of modified silicone materials are the reaction products of siloxanes or alkoxy silanes (containing silanol functionality) with organic polymers containing hydroxy groups, such as the incompletely esterified acrylates, epoxys, or the like to provide polymers of the following general formula:

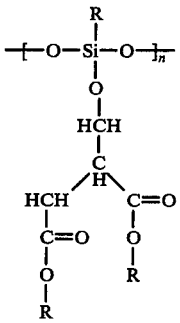

where R is a saturated or unsaturated alkyl group, hydrogen, a halogen or other organic group having less functionality than the base polymer.

The unsaturated acrylate copolymers which are useful in the present invention are substantially ethylacrylate which contains a few percent of a co-monomer, such as allylacrylate and which is co-polymerized to form the desired prepolymer.

Suitable block copolymers of styrene and butadiene are the materials such as Kraton D sold by the Shell Chemical Company. As previously mentioned, it is preferred that a polyfunctional cross-linking monomer material be included with the polymer. The monomer material is selected so as not to cross-link merely on the application of heat but to readily cross-link on the application of irradiation. The amount used may be varied depending on the properties of the monomer selected and its functionality but generally amounts of less than 10 percent by weight of the polymer material have been found suitable. Preferred monomer materials are the solid or highly viscous acrylates. Specific monomers are pentaerythritol triacrylate, ethoxylated bis-phenol A dimethacrylate, dipentaerythritol monohydroxypenta acrylate, pentaerythritol tetracrylate, pentaerythritol tetramethacrylate, triallyl cyanurate, diallyl melamine, diallyl maleate, divinyl benzene and the like.

Critical properties of the polymer or combination of polymer and monomer materials used in the present invention are that the material should soften at 150° C or less and have a melting point not much higher than 160° to 180° C. The polymer should also contain unsaturation sites which are susceptible to cross-linking when subject to radiation energy.

The polymer material is extrudable so that it may be extruded into continuous filaments. Generally better bond or adhesion is obtained if the bonding prepolymer or polymer is of the same chemical nature as the non-bonding filaments which are to be bonded.

When choosing a specific monomer material to be used in accordance with the present invention, consideration should be given to the melting temperature of the monomer so that the resulting monomer-polymer mixture still meets the melting and softening parameters previously described. The partial vapor pressure of the monomer should be relatively low so that it is not removed when extruded. The monomer should also be compatible with the polymer to simplify the mixing of the materials. It has been found helpful to incorporate with the polymer or the polymer-monomer mixture a small amount of a commercially available polymerization inhibitor such as hydroquinone. These materials provide the polymer with greater shelf-life and reduce the problem of undesired polymerization when the polymer is subjected to some heat as in the extrusion process.

The fabrics produced in accordance with the present invention may range from as low as 50 grains per square yard to a couple of thousand grains per square yard. The fabrics may also include a combination of non-bonding type filaments and may be made in virtually any width as desired. The resulting fabrics may have use by themselves or they may be laminated or incorporated with films, nonwoven fabrics, woven fabrics, etc.

In the manufacture of my new spunbond fabric the techniques for melting the polymers are well known in the art. Molten polymer may be extruded through standard screw extruders and any of the standard spinnerettes may be used. Usually these spinnerette assemblies are rectangular in shape and cover substantially the entire width of the conveying means on which the filaments are to be collected or they may be circular in shape and oscillated back and forth as desired to obtain a uniform lay of the filaments across the entire conveyor width. The extruded fiber-forming filaments are partially drawn to orient the molecules in the filaments as is well known in the art. The oriented or at least partially oriented filaments are collected on any of the standard movable conveyors which are permeable and allow for air to pass through so as not to disrupt the lay of the filament. As previously mentioned, if desired after the web is formed, it may be heated and compressed slightly to embed filaments together. This may be accomplished by a set of calendering rolls or similar techniques well known in the art. This heating makes the filaments more fluid and allows filaments to wet and intimately contact each other. The web with the two different types of filaments is treated with electron beam radiation and the bonding filaments cross-linked. The radiation used should have a wave length of from 0.001 Angstrom to 1 Angstrom with a frequency of $10^{18}$ cycles per second to $10^{21}$ cycles per second and with an energy of $10^5$ electron volts to $10^7$ electron volts. Suitable radiation sources are the high energy beam radiation units manufactured by Energy Sciences, Inc. of Bedford, Massachusetts and High Voltage Engineering of Burlington, Massachusetts. The radiation dosage applied to the web is from three to eight megarads.

The type and amount of radiation is important. The electron beam radiation eliminates the shadow effect which is often given with other types of radiation; that is, filaments at the bottom of the web or the surface furthest disposed from radiation source are protected by the shadows of the filaments above them. When this happens the degree of bonding or amount of adhesion will decrease as you move from the surface of the web closest to the source to the opposite surface. I have not seen this type of phenomenon using electron beam radiation within the ranges described above but have noted good uniformity of degree of bonding from one surface of the web to the opposite surface.

It is important during the radiation step to exclude oxygen from the radiation zone to obtain more efficient and complete polymerization and bonding to filaments. This may be accomplished quite readily by carrying out the irradiation in an atmosphere of nitrogen or other inert gas.

The following example is illustrative of the method and fabric of the present invention.

EXAMPLE

A prepolymer to be used in forming the bonding filaments is produced by charging 928 grams of cyclohexane diol and 464 grams of maleic acid in a 3-liter vacuum reactor and polymerizing. Water is removed to an acid number of 40. The resultant polymer is removed from the reactor and allowed to cool. The polymer has a melting point of about 172° C.

Six hundred grams of the polymer is blended with 108 grams of sodium methacrylate to produce a mixed solid having a softening temperature of about 147° C. About 35 grams of pentaerythritol triacrylate and 100 parts per million of hydroquinone stabilizer is added to the mixed solid. This mixture is melted and extruded into three denier monofilaments. Simultaneously therewith, a polyester polymer is melted and extruded into three denier monofilaments. The two polymers are fed to a group of spinnerettes as shown in FIGS. 2 and 3. Every fifth spinnerette orifice is fed with the bonding polymer mixture while the remaining orifices of the spinnerette are fed with the polyester polymer.

The polymers are extruded downwardly through the spinnerette in between a series of metal plates. Air is blown down along the surface of the extruded filaments and the filaments collected on a permeable moving conveyor. Most of the air is allowed to pass through the conveyor. The spinnerettes are oscillated back and forth about a distance of 2 inches to form a uniform lay of the polyester filaments and of the bonding filaments. The total weight of the web is about 200 grains per square yard and is made up of 75 percent polyester filaments and 25 percent bonding filaments. The web is subjected to heat and pressure to fuse and embed filaments together. The heated and pressed web is exposed to electron beam radiation at a dosage of about 8 megarads to further polymerize the bonding polymer and cross-link this polymer. The resultant spunbond fabric is very resistant to solvents and water and there is substantially no change in its dry and wet tensile strength.

Having now described the invention in specific detail and exemplified the manner in which it may be carried into practice, it will be readily apparent to those skilled in the art that innumerable variations, modifications, applications and extensions of the basic principles involved may be made without departing from the spirit and scope. I intend to be limited, therefore, only in accordance with the appended patent claims.

What is claimed is:

1. A new nonwoven fabric comprising a layer of substantially continuous, randomly disposed, filaments, a portion of said filaments being at least partially molecularly oriented, crystalline, synthetic polymer and another portion of said filaments being electron beam radiation cross-linked polymerized materials selected from the class consisting of the unsaturated polyester polymers, the unsaturated polyurethane polymers, the unsaturated epoxy bis-phenol A resins, modified silicones, unsaturated acrylate copolymers, block copolymers of styrene and butadiene and mixtures thereof, said cross-linked polymerized filaments being bonded to each other and to said molecularly oriented filaments to produce a unitary web.

2. A nonwoven fabric according to claim 1 wherein the partially molecularly oriented, crystalline, synthetic polymer forms from about 50 to 95 percent by weight of the fabric and the remainder of the fabric is cross-linked, polymerized material.

3. A nonwoven fabric according to claim 1 wherein the partially molecularly oriented, crystalline, synthetic polymer filaments have a denier of from about 1 to 5.

4. A nonwoven fabric according to claim 1 wherein the partially molecularly oriented, crystalline, synthetic polymer is a polyester.

5. A nonwoven fabric according to claim 1 wherein the partially molecularly oriented, crystalline, synthetic polymer is a polyamide.

6. A nonwoven fabric according to claim 1 wherein the partially molecularly oriented, crystalline, synthetic polymer is a polyolefin.

7. A nonwoven fabric according to claim 1 wherein the partially molecularly oriented, crystalline, synthetic polymer is a polyester and the cross-linked polymerized material is an unsaturated polyester polymer.

8. A method of producing a spunbond fabric comprising; simultaneously extruding a synthetic fiber-forming, molecularly orientable polymer and a cross-linkable polymerizable material selected from the class consisting of the unsaturated polyester polymers, the unsaturated polyurethane polymers, the unsaturated epoxy bis-phenol A resins, modified silicones, unsaturated acrylate copolymers, block copolymers of styrene and butadiene, and mixtures thereof, said polymers being extruded through a spinnerette to form filaments with the cross-linkable polymerizable material being extruded in orifices uniformly disposed amongst orifices extruding said fiber-forming polymer, drawing said fiber-forming polymer filaments to at least partially orient said filaments, collecting both the fiber-forming polymer filaments and the other filaments on a permeable movable conveyor in web form containing randomly disposed filaments and treating said web with electron beam radiation to cross-link the cross-linkable polymer and bond the filaments together to produce a strong, durable, nonwoven fabric.

9. A method according to claim 8 wherein the layer of filaments is heated and pressed to embed filaments together prior to being treated with electron beam radiation.

10. A method according to claim 9 wherein the web is further compressed after being treated with electron beam radiation.

11. A method according to claim 8 wherein the layer of filaments is treated with electron beam radiation in a dosage of from three to eight megarads.

12. A method according to claim 8 wherein approximately one out of every five orifices is fed with the cross-linked polymerizable material and the remaining orifices are feb with the fiber-forming polymer.

13. A method according to claim 8 wherein the cross-linkable polymerizable material includes a polyfunctional cross-linking monomer material.

14. A method according to claim 8 wherein the radiation used has a wave length of from 0.001 to 1 Angstrom, a frequency of $10^{18}$ to $10^{21}$ cycles per second, and an energy of $10^5$ to $10^7$ electron volts.

* * * * *